US005337563A

United States Patent [19]

Weber

[11] Patent Number: 5,337,563

[45] Date of Patent: Aug. 16, 1994

[54] STIRLING ENGINE WITH HEAT EXCHANGER

[76] Inventor: Eckhart Weber, Am Laufer Schlagturm 6, D-8500 Nürnberg 1, Fed. Rep. of Germany

[21] Appl. No.: 58,603

[22] Filed: May 6, 1993

[30] Foreign Application Priority Data

May 21, 1992 [DE] Fed. Rep. of Germany ..... 4216839

[51] Int. Cl.[5] ..... F02G 1/043; F02G 1/057

[52] U.S. Cl. ..... 60/520; 60/526

[58] Field of Search ..... 60/520, 526, 517, 641.14; 62/6

[56] References Cited

U.S. PATENT DOCUMENTS 3,604,821 9/1971 Martini ..... 60/526
4,183,214 1/1980 Beale et al. ..... 60/520
4,404,802 9/1983 Beale ..... 60/517
4,490,974 1/1985 Colgate ..... 60/520
4,642,988 2/1987 Benson ..... 60/526
4,856,280 8/1989 Chagnot ..... 60/520
4,945,726 8/1990 Beale ..... 60/520

*Primary Examiner*—Tony M. Argenbright
*Assistant Examiner*—M. Macy
*Attorney, Agent, or Firm*—Anderson Kill Olick & Oshinsky

[57] ABSTRACT

A stirling engine including a heat exchanger having a displacer plate, which moves to and fro between two spaced parallel housing plates of the heat exchanger housing and which divides the housing into an expansion chamber and a compression chamber, cooling and heating devices associated with the displacer plate, distributed struts extending between the spaced parallel housing plates and penetrating the displacer plate, and a linear roller diaphragm which guides the displacer plate with respect to the end faces of the housing.

21 Claims, 9 Drawing Sheets

STIRLING ENGINE WITH HEAT EXCHANGER

Figure 1:
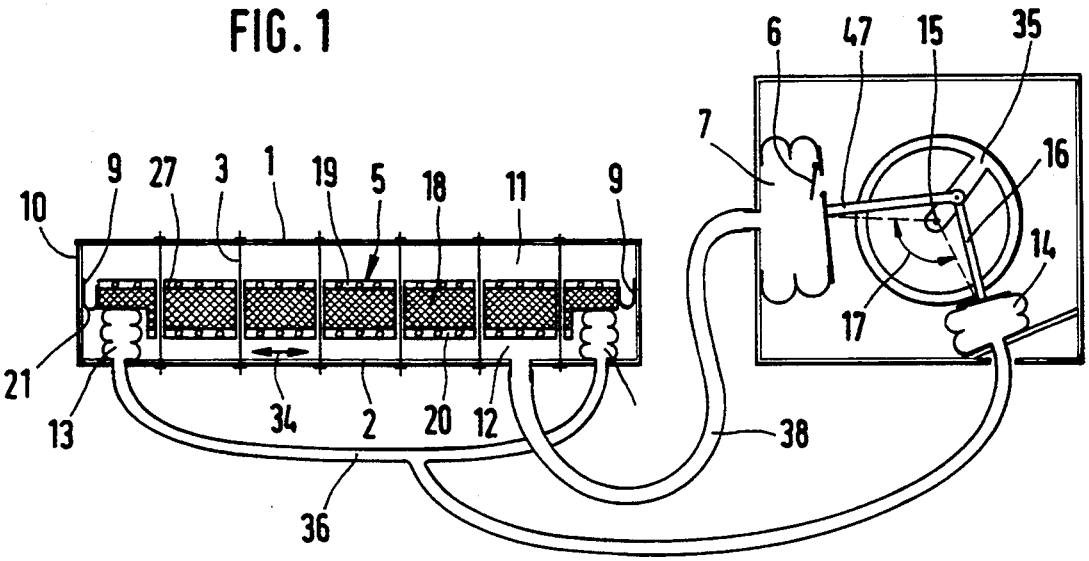

The invention relates to a Stirling engine with a heat exchanger, designed for low-temperature to medium-temperature operation, that is to say for a small compression ratio and a large displaced volume, in which a displacer plate is movable to and fro between two mutually parallel housing plates of a housing and is free of sliding friction along the periphery with respect to the end faces of the housing, the displacer plate separating two working-gas part-volumes, the expansion chamber and the compression chamber, from one another, with which for the purpose of heat exchange cooling means and heating means are associated, the two working-gas part-volumes being connected to one another by way of a regenerator, and the to-and-fro movement of the displacer plate being timed to a working piston with phase offset.

In a known (DE-DS 30 15 815) Stirling engine of this type, the two housing plates are supported with respect to one another only by way of the walls forming the end faces, and the displacer plate has at the end edges some play with respect to the end faces of the housing. If, with this Stirling engine, the intention were to make the surfaces of the housing plates and of the displacer plate larger in order to achieve higher output, then there are limits to this because the housing plates can only withstand the increased pressure if the construction is complicated. For this reason, in the known Stirling engine a plurality of relatively small engine modules are grouped together to form a unit in order to produce an engine in the increased output range. The complexity of construction associated with a plurality of relatively small engine modules is relatively high, since each module has to be produced and has to be connected by way of a plurality of linkages to the engine shaft.

It is thus an object of the invention to provide a Stirling engine of the type mentioned at the outset which is designed for increased output ranges whilst having a reduced complexity of construction, in that the housing plates and the displacer plate are of as large as possible a construction whilst taking into account the compressive strength of the housing. This object is achieved by the Stirling engine according to the invention which is characterized in that the two housing plates are held spaced from one another by distributed struts, the struts, being arranged perpendicular to the displacer plate and passing there-through, and in that the displacer plate is guided with respect to the housing end faces along its end edges by linear roller diaphragms.

In the Stirling engine according to the invention, the housing plates and the displacer plate can be constructed to be unusually large, since the housing plates are stabilized with respect to one another over their surface by the struts. For example, an output range of 50–500 W can be achieved, the housing plates being several square meters in area and working pressures of 10,000 pa and above occurring in the working-gas part-volumes. The struts should pass through the displacer plate in a manner which is guided as snugly as possible, so that the apertures through the displacer plate necessitated by the struts do not result in unacceptable gas passage between the expansion chamber and the compression chamber. For this reason, it is necessary to maintain the displacer plate precisely parallel, and this precise parallel to the housing plates guidance is provided by the roller diaphragms. As a result of the roller diaphragms, an application of the struts between the housing plates which is usable in practice is achieved. The connection between the displacer plate and the engine shaft can be a conventional one made exclusively by way of linkages. However, it is particularly convenient and advantageous if, for the to-and-fro movement of the displacer plate, motion air expansion bags are provided between the displacer plate and one housing plate, which motion air expansion bags are actuable by means of a control expansion bag and are connected thereto conductively for the supply and removal of air, this control expansion bag being contractable and expandable by way of a connecting rod. The movement of the displacer plate by means of the motion air expansion bags distributed over the surface thereof results in an improved parallel guidance of the displacer plate. In particular, the sliding friction of guided motion rods of the connecting linkage is avoided. Linking the displacer plate to the engine shaft by means of the motion air expansion bags, the air supply and removal and the control expansion bag is important in the case of a considerably enlarged displacerplate, for which precise parallel guidance with respect to the housing plates and low friction during movement are crucial. The volume of the motion air expansion bags is compensated by the change in phase relation between the movement of the displacer plate, that is to say the movement of the control expansion bag, and the movement of the working expansion bag from what is normally 90 degrees to greater than 90 degrees.

The struts may be constructed such that they can take up tensile and compressive forces. A small connection from the engine compartment to the surrounding atmosphere ensures that the air pressure in the working expansion bag is on average identical to atmospheric pressure.

It is particularly convenient and advantageous if either the struts are each constructed as tensioning tie rods and a non-return valve sets the air pressure in the working expansion bag to a value equal to or greater than atmospheric pressure, or the struts are each constructed as reinforcing supports and a non-return valve sets the air pressure in the working expansion bag to a value equal to or smaller than atmospheric pressure. With this optional construction, the function of the struts is clear and the complexity of construction is simplified. Setting to either only pressure conditions or only suction conditions also makes feasible application opportunities which are specific to each case.

A particularly convenient and advantageous embodiment of the invention is provided if the regenerator is provided on the displacer plate and extends over the entire surface thereof. This simplifies the sealing and guidance conditions between the end edges of the displacer plate and the end side walls of the housing. There is also provided according to the invention, an adaptation of the dimensions of the regenerator to the enlarged surfaces of the heat exchangers and the flow resistance of the regenerator is thereby reduced.

The regenerator acts through the volume of the displacer plate, which may have for example a thickness of 0.1 m and can be made for example of open-pore polyester foam. The moving regenerator forms, on the surfaces facing the housing plates, the heat exchangers, which move with the housing plate and are constructed such that gas can flow through them. The cooling means/heat exchanger is typically arranged on the underside of a horizontal displacer plate.

The present Stirling engine in the output range of 50–500 W is particularly suitable in sunny regions for conveying water, for refrigeration and for producing electrical current, or for grinding cereals. It can be produced from simple materials without precision parts and is thus suitable for production even in non-industrialized countries.

Figure 3:
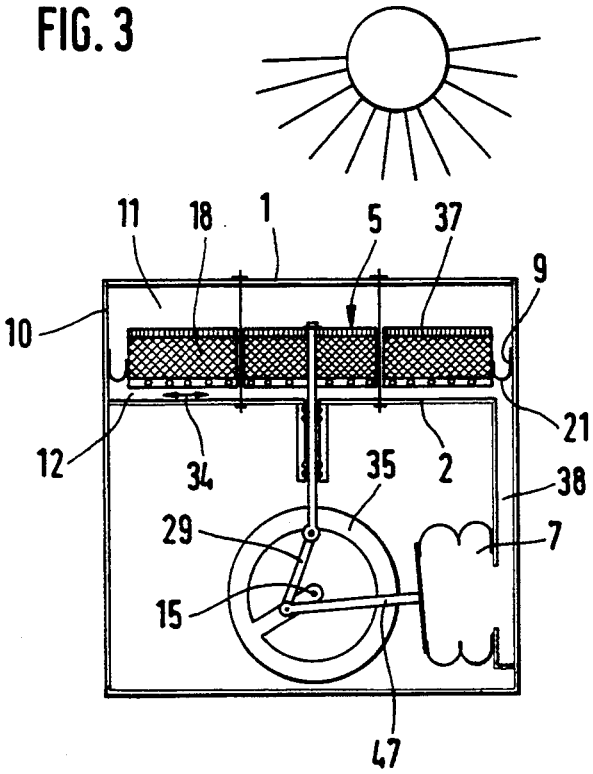
Figure 2:
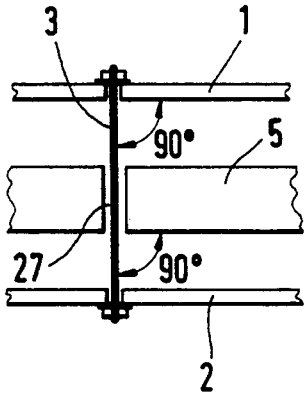
Figure 4:
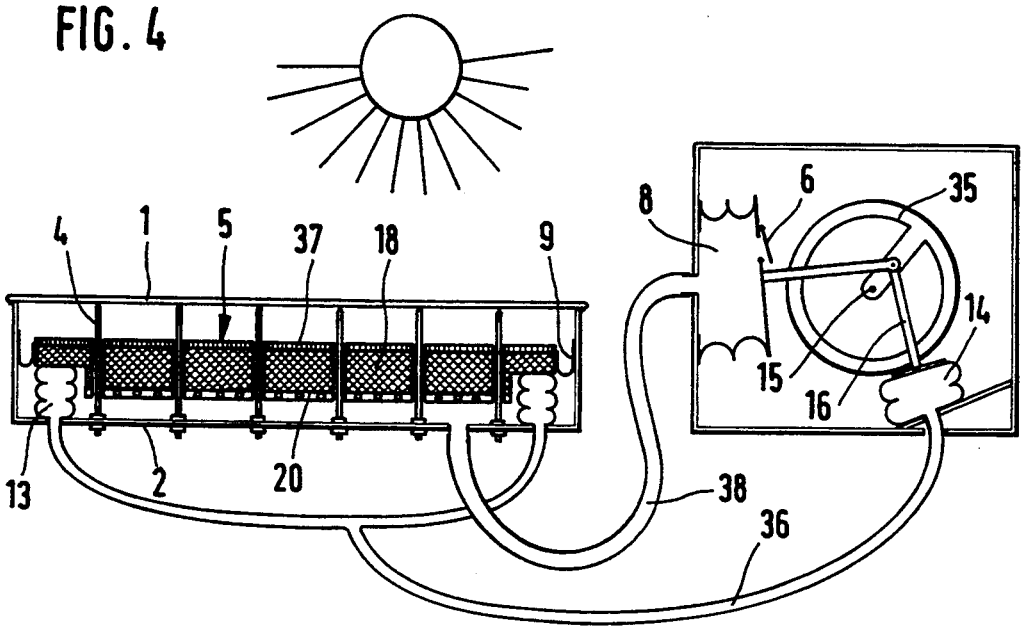
Figure 5:
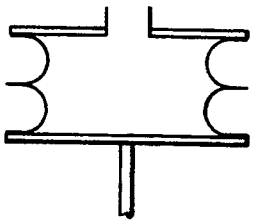
Figure 6:
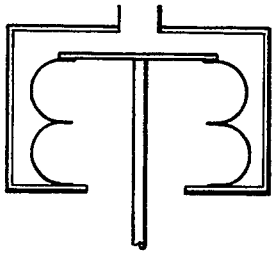
Figure 7:
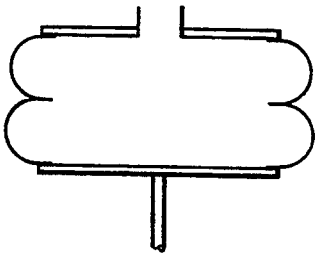
Figure 8:
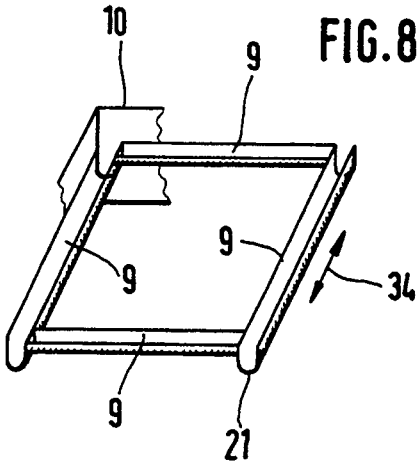
Figure 10:
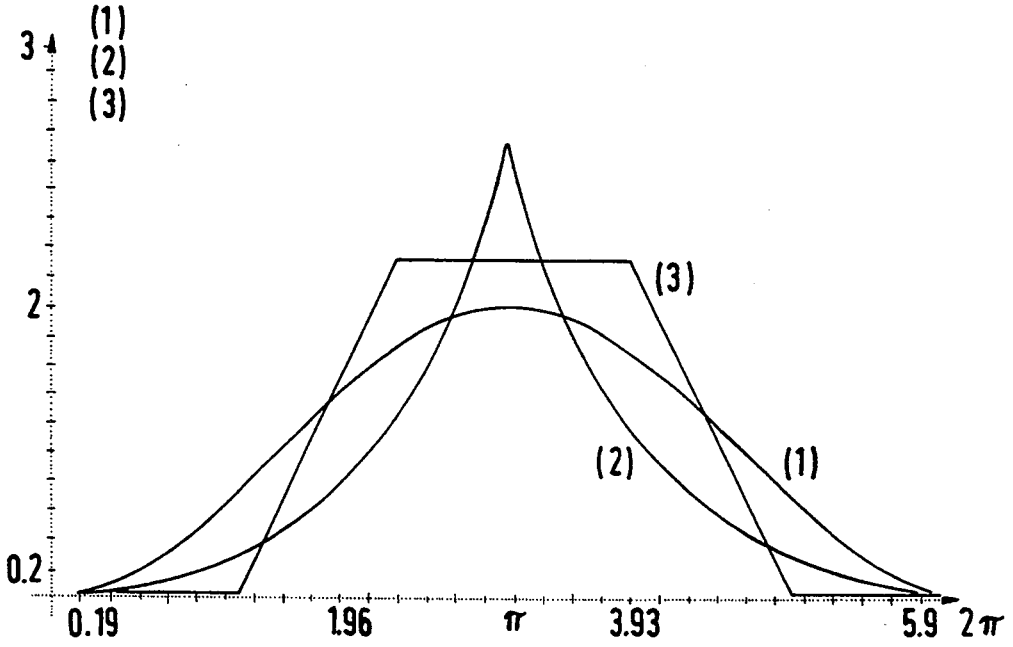
Figure 12:
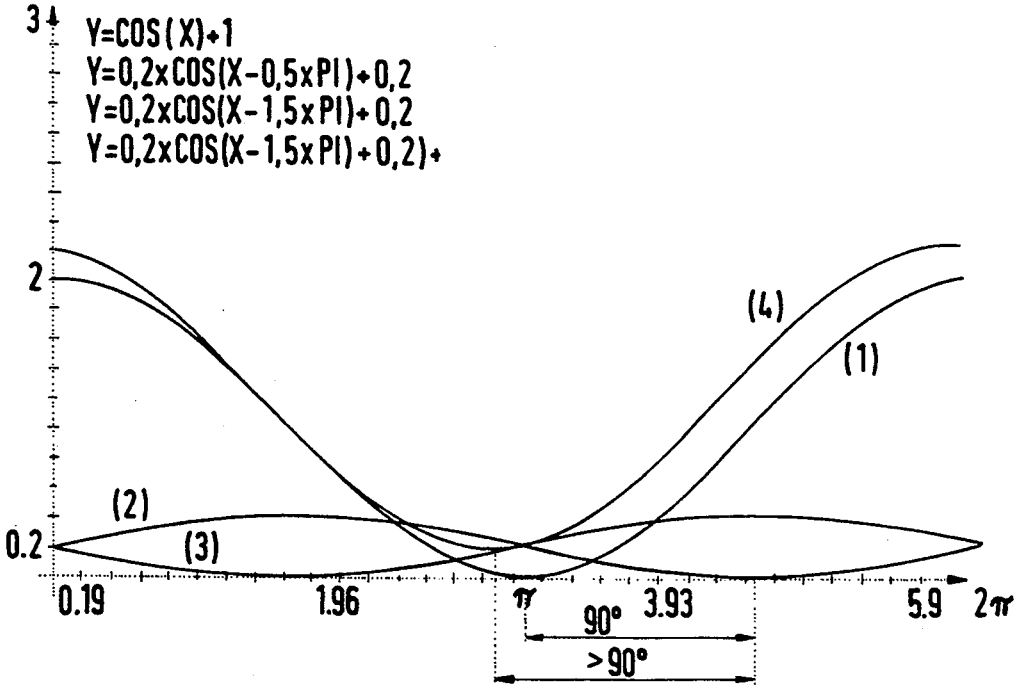
Figure 9:
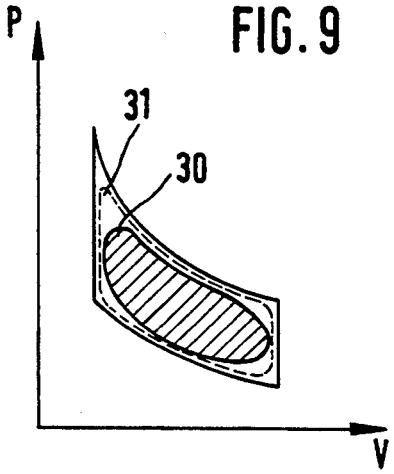
Figure 11:
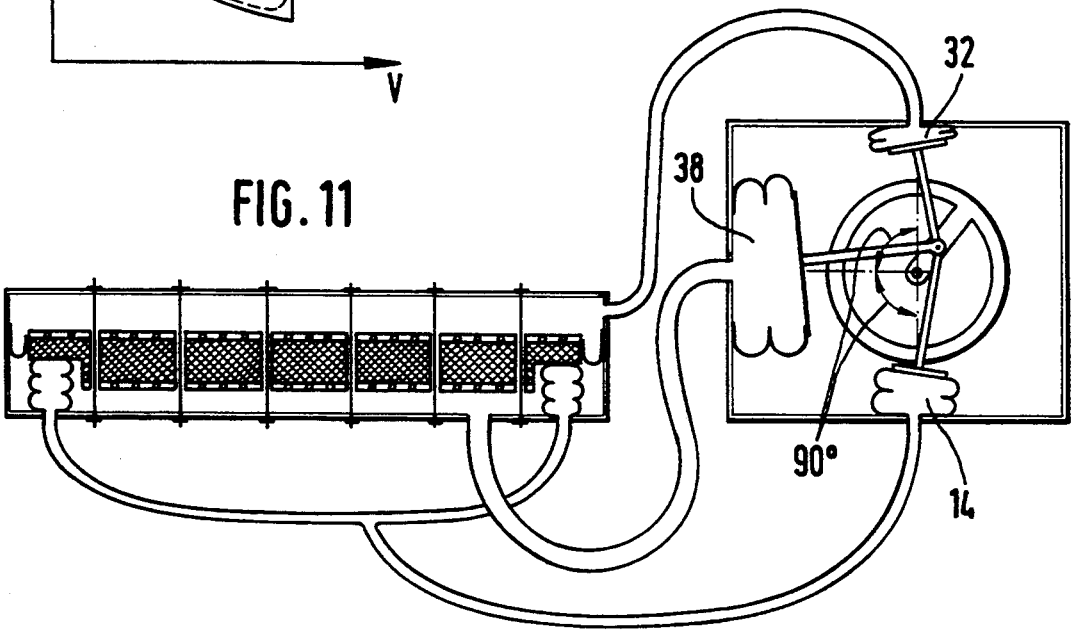
Figure 11:
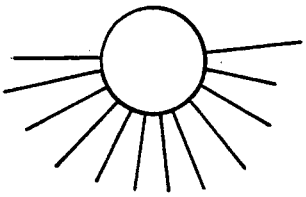
Figure 13:
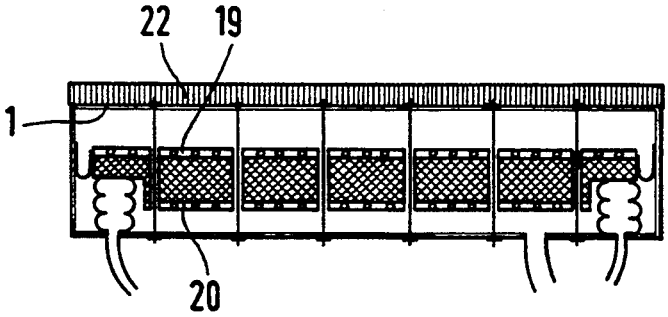
Figure 14:
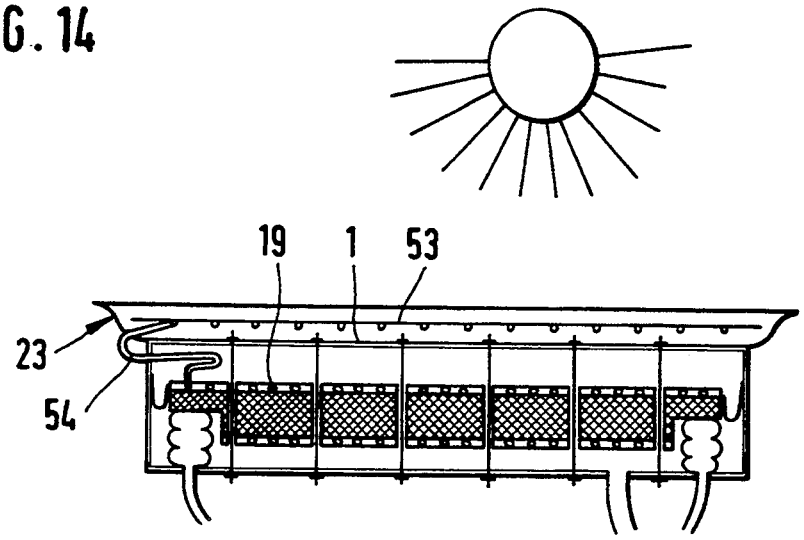
Figure 15:
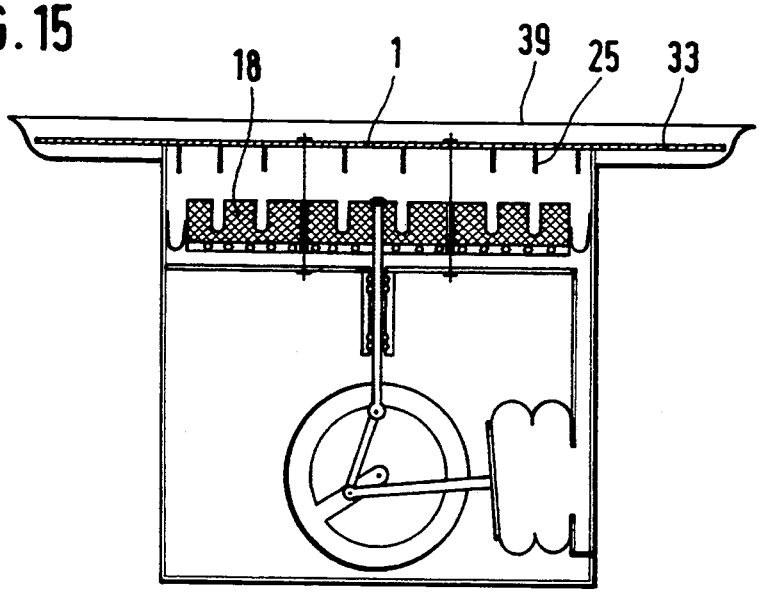
Figure 16:
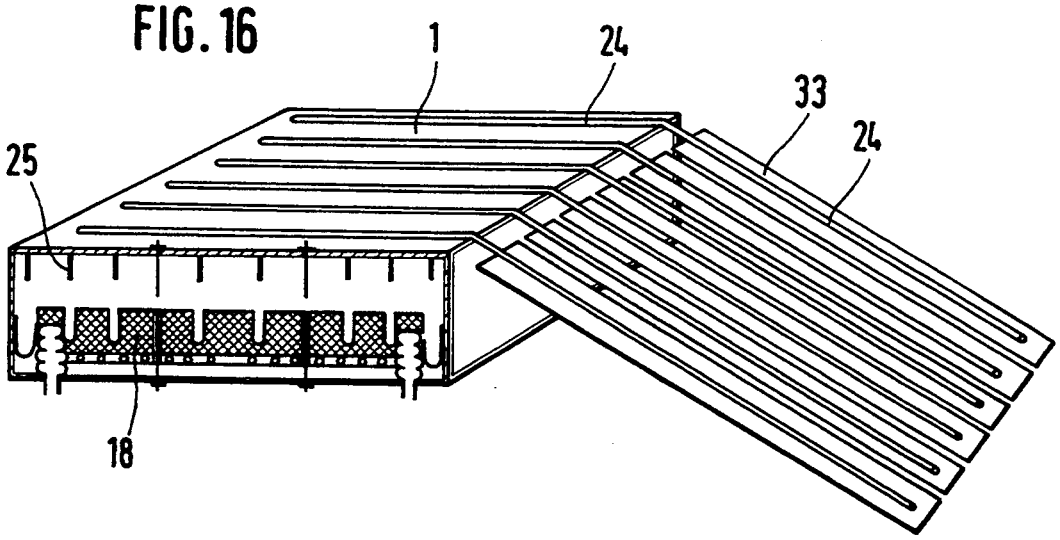
Figure 17:
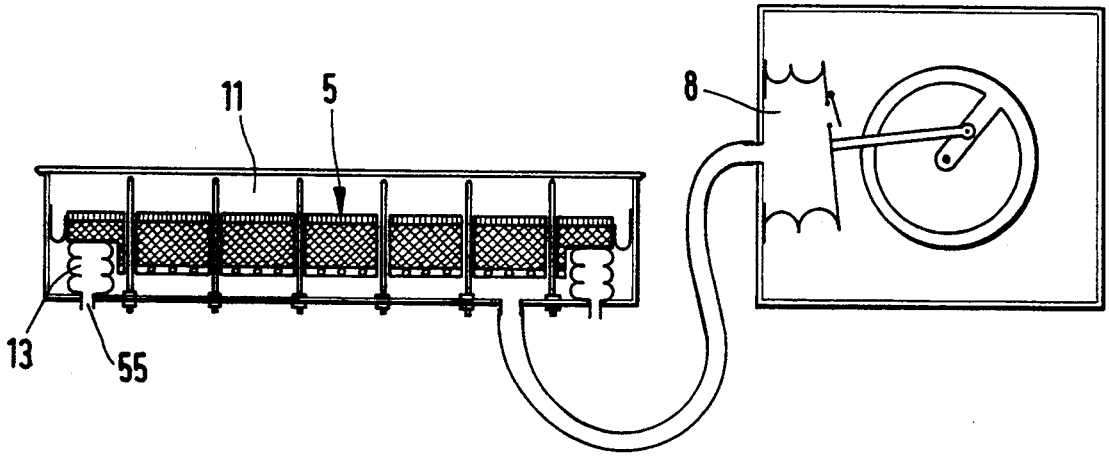
Figure 18:
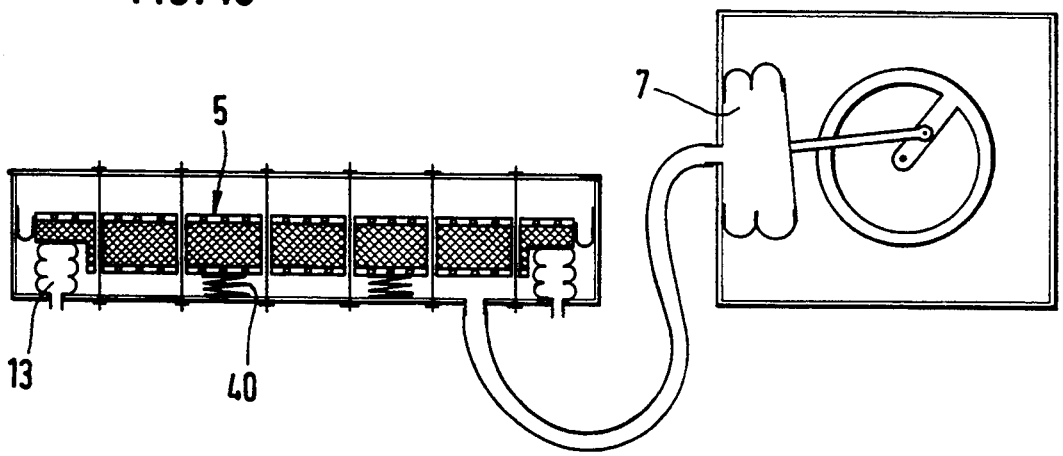
Figure 19:
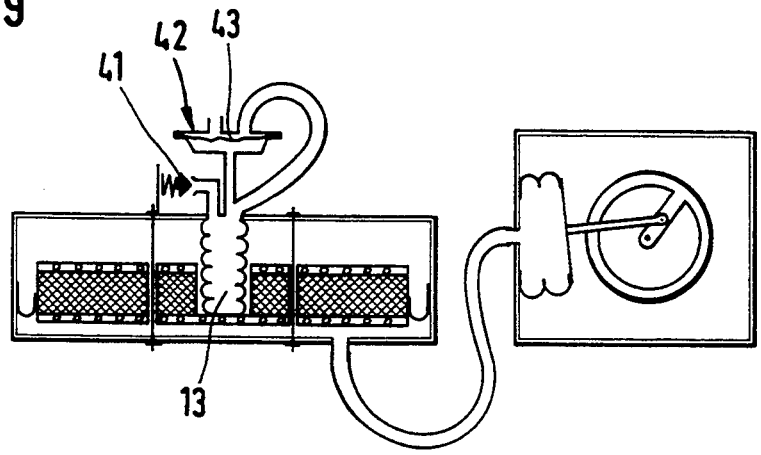
Figure 20:
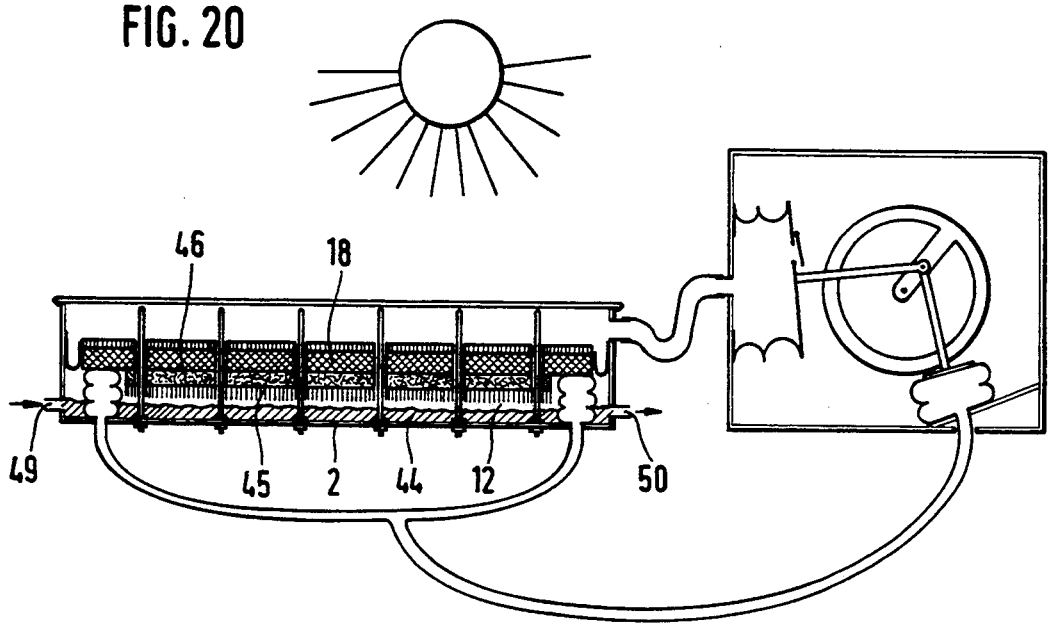
Figure 21:
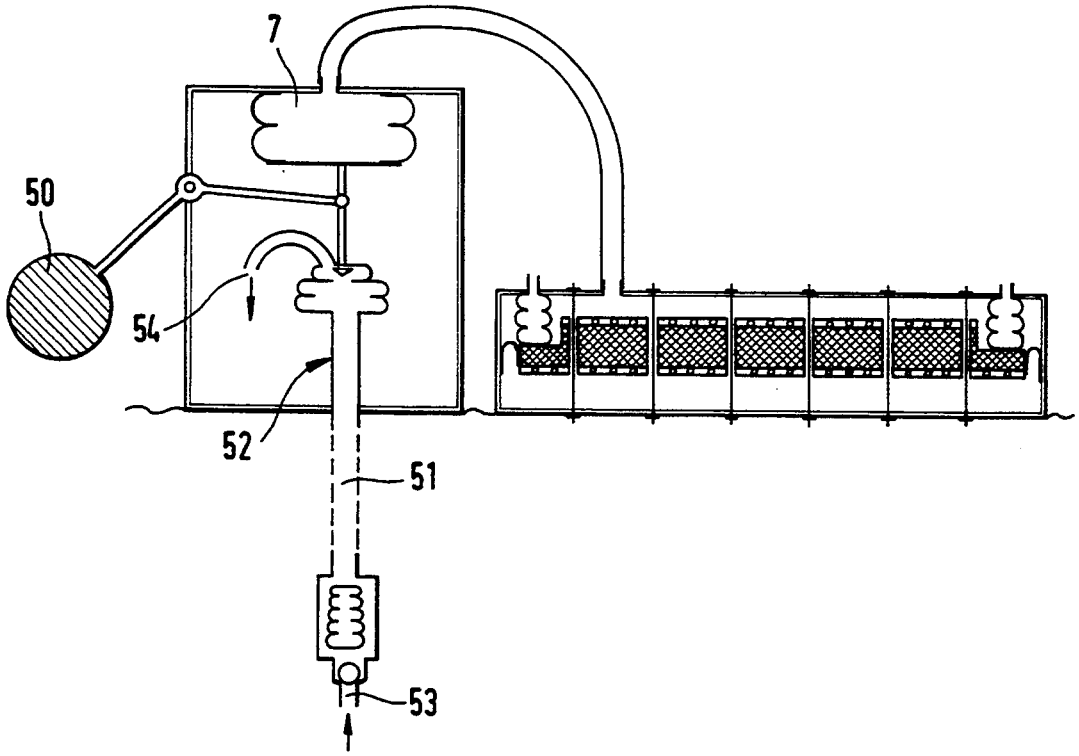
Figure 22:
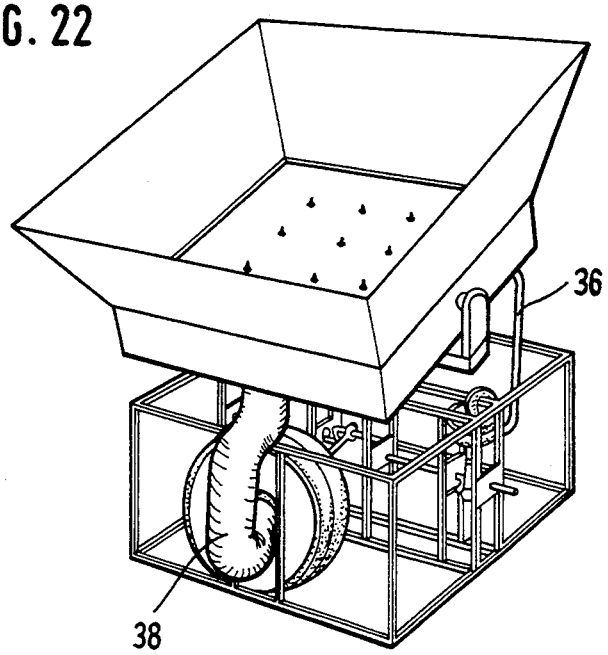
Figure 23:
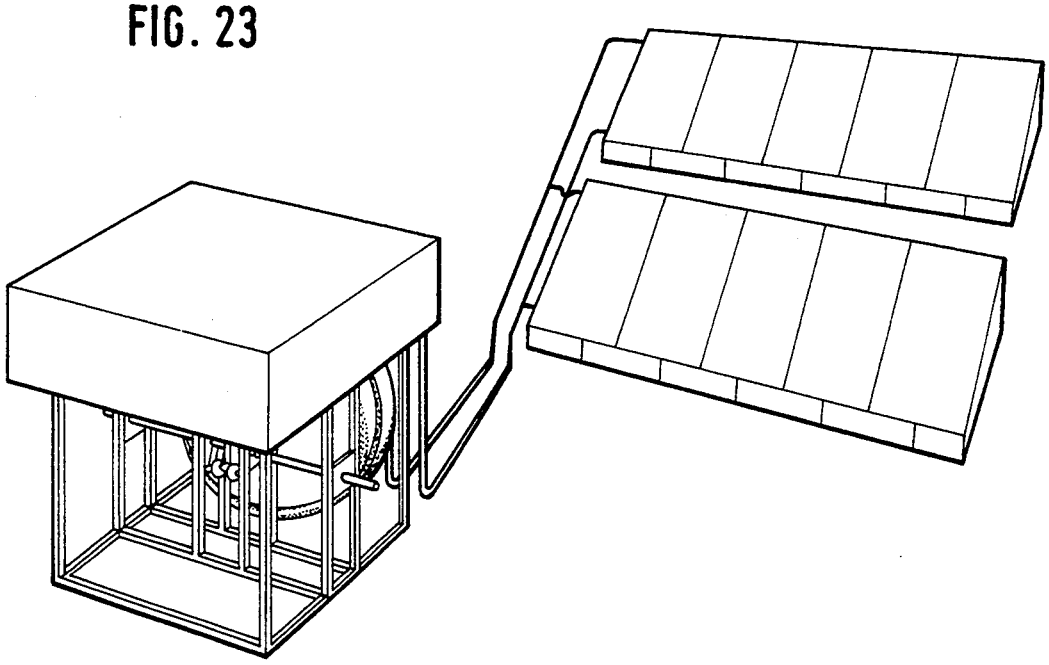
Figure 24:
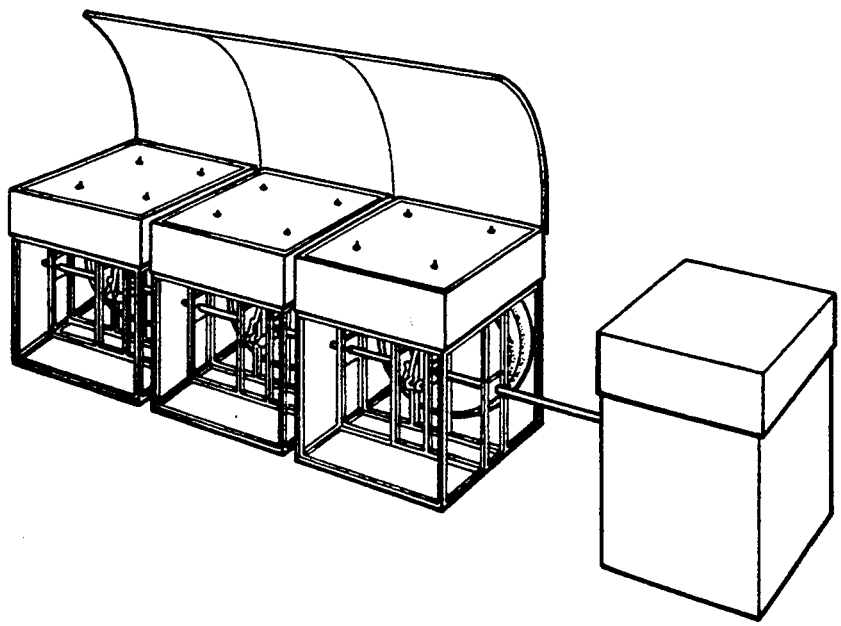

The drawing illustrates preferred embodiments of the invention. Here:

FIG. 1 shows a first Stirling engine with a heat exchanger, diagrammatically in section, FIG. 2 shows a detail of the Stirling engine according to FIG. 1, on a larger scale than FIG. 1, FIG. 3 shows a second Stirling engine with a heat exchanger, diagrammatically in section, FIG. 4 shows a third Stirling engine with a heat exchanger, diagrammatically in section, FIGS. 5 and 6 each show a suction expansion bag, diagrammatically in section, FIG. 7 shows a pressure expansion bag, diagrammatically in section, FIG. 8 shows a perspective view of the roller diaphragms around the displacer plate, FIG. 9 shows an indicator diagram illustrating the relationship between working-gas pressure and working-gas volume, FIG. 10 shows graphs of individual conditions in a Stirling engine with a heat exchanger, FIG. 11 shows a fourth Stirling engine with a heat exchanger, diagrammatically in section, FIG. 12 shows graphs of individual conditions of the Stirling engine according to FIG. 11, FIG. 13 shows a displacer plate housing of a fifth Stirling engine, diagrammatically in section, FIG. 14 shows a displacer plate housing of a sixth Stirling engine, diagrammatically in section, FIG. 15 shows a side view of a first enlarged housing plate, FIG. 16 shows a perspective view of a second enlarged housing plate, FIG. 17 shows an eighth Stirling engine in a first embodiment without control expansion bag, diagrammatically in section, FIG. 18 shows a ninth Stirling engine in a second embodiment without control expansion bag, diagrammatically in section, FIG. 19 shows a tenth Stirling engine in a third embodiment without control expansion bag, diagrammatically in section, FIG. 20 shows an eleventh Stirling engine with a second embodiment of the lower heat exchanger, diagrammatically in section, FIG. 21 shows a twelfth Stirling engine in an embodiment without engine shaft, diagrammatically in section, FIG. 22 shows a perspective view of a Stirling engine according to FIG. 1, with a displacer box which can follow the sun about two axes, FIG. 23 shows a perspective view of a Stirling engine according to FIG. 3, with a solar collector panel, FIG. 24 shows a perspective view of a group of Stirling engines according to FIG. 3, which drive a engine according to FIG. 1 or 4, with two displacer boxes.

The Stirling engine according to FIGS. 1 and 2 includes a heat exchanger which has a substantially rectangular housing formed by two housing plates 1, 2 and four rectangularly surrounding housing and walls 10. Struts constructed as tie rods 3 are every distributing over the surface of the housing plates 1, 2 and are fixed at either end in each case to one of the housing plates. The tie rods pass through bore 27 in a rectangular displace plate 5 which is accommodated the housing and whereof the end faces are spaced peripherally from the housing end walls 10. Secured to each of the end faces is a longitudinal side of a roller diaphragm 9, the other longitudinal side of which is directly secured to the associated end wall 10. The roller diaphragm 9 is a strip running along the end face and forming a fold 21 in its longitudinal direction. The displacer plate 5 forms for the most part a plate-shaped regenerator 18, on the upper surface of which there is provided a boating means 19 for heat exchange and on the other surface of which there is provided a cooling means 20 for heat exchange. The displacer plate 5 divides the housing into an expansion chamber 11 and a compression chamber 12, and is mounted at the bottom on raising expansion bags 13.

Fluid lines 36 go out from the raising expansion bags 13 and a fluid line 38 goes out from the compression chamber 12, each of these lines leading to a respective part of an engine having a crank drive. Specifically, the fluid line 38 leads from the compression chamber 12 to a working expansion bag 7 with which there is associated a non-return valve 6. The working expansion bag 7 acts by way of a connecting rod 47 on a crankshaft or engine shaft 15 bearing a flywheel 35. The fluid lines 36 coming from the raising expansion bags 13 lead to a control expansion bag 14 which is connected by way of a connecting rod 16 to the engine shaft 15. In relation to the engine shaft 15, the working expansion bag 7 and the control expansion bag 14 are offset with respect to one another by a phase relation 17 larger than 90 degrees. FIG. 2 illustrates the connection between the housing plates, the displacer plate 5, the bores 27 and the tie rods 3.

The Stirling engine according to FIG. 3 is to a large extent constructed as in FIGS. 1 and 2. The fold direction 34 of the fold formed by the roller diaphragm 9 runs along each end edge. The regenerator plate 5 is connected to the engine by way of a linearly guided pushrod 28 which passes through a guide means 48 and acts on the engine shaft 15 by way of a connecting rod 29.

If the intention is to construct Stirling engines which are larger than approximately 1 by 1 m, which is still just possible using curved housing surfaces, the stabilization of the housing chamber walls presents difficulties, since the working pressure of 10,000 pa in the engine seeks to push the walls apart at tonne. A massive steel-reinforced construction is complex and, if a housing plate is to be transparent, would hinder the incidence of light into the engine.

In accordance with FIGS. 1–3, the housing of high compression strength is achieved by the tie rods 3 tensioning the two mutually opposing housing plates 1, 2, and the air pressure in the engine being kept to greater than or equal to atmospheric pressure by the non-return valve 6 allowing air to flow only into the engine, because the tie rods can only be loaded by tensile stress. The working expansion bag 7 operates as a pressure expansion bag (air pressure in the expansion bag ⊥ atmospheric pressure). Here, one housing plate 1 can be of transparent unbreakable polycarbonate. If, in accordance with FIG. 4, highly transparent breakable Sekurit glass is to be used for the upper housing plate 1, it is particularly simple to use instead of the tie rods supports 4 on which the glass plate lies only loosely. The air pressure in the engine is now held by the reversed non-return valve 6 to be less than or equal to atmospheric pressure, by allowing air to flow only out of the engine. Now, a working expansion bag 8 operates as a suction expansion bag (cf. FIGS. 5 and 6). The glass pane is held by suction against the supports and does not break if there is a sufficient number (approx. 25/m2) of the supports. If the struts are constructed such that they can be loaded both by tensile stress and by pressure, then the pressure in the engine can be kept on average at atmospheric pressure by a small bore instead of by the non-return valve, as a result of which the engine can have a smaller flywheel mass.

In the known (DE-OS 30 15 815) Stirling engine, guidance of the displacer plate is not defined. The displacer plate performs a pivotal movement in addition to the to-and-fro movement between the housing plates, because of the rotary movement performed by the drive linkage. The displacer plate cannot bear against the regenerator without play and thus, although it is free of sliding friction along its periphery, it does not seal the working-gas part-volumes formed by the expansion chamber and the compression chamber from one another.

In the present Stirling engine, the tie rods 3 or supports 4 are perpendicular to the two parallel housing plates 1, 2 and pass perpendicular through the displacer plate 5 (FIG. 2), which has to be guided precisely in a manner free of wear and friction and must not brush against the tie rods or struts, although the bores 27 through which the tie rods pass must be barely larger than the diameters of the tie rods in order to ensure the separation of the expansion chamber and the compression chamber. Moreover, the displacer plate is very heavy in the preferred embodiment described below (approx. 30 kg/m2). This weight has to be borne by the displacer plate guidance means, since the engine is to operate in all positions. The guidance means according to the invention comprises the linear roller diaphragm 9 (with a square or rectangular housing, four of these are provided), which guide the displacer plate precisely and at the same time seal it from the housing end wall 10 in a manner free of sliding friction. The linear roller membranes are, in contrast to round roller holders or hose-type roller expansion bags, wear-free, since they are subject to virtually no flexing and, an absolute necessity in the Stirling engine, they can operate without a pressure difference between the inner and outer side. The linear fold 21 is capable of bearing a load in the fold direction 34 and can bear the weight of the displacer plate (when the engine is operated non-horizontally). The precise sealing between the displacer plate and the housing wall or regenerator is absolutely necessary in the interests of a high degree of efficiency (efficiency of the engine according to the invention was measured as 60% of Carnot). The above-mentioned known engine has, in addition to a major deficiency as regards regenerator volume, considerable gap losses between the displacer and the regenerator, so that it does not achieve an acceptance degree of efficiency (measured as $<1\%$ of Carnot).

The illustrations in FIGS. 5 to 7 are each enlarged with respect to the illustrations in FIGS. 1, 3 and 4. FIGS. 5 and 6 each show a construction of a suction expansion bag, and FIG. 7 shows a construction of a pressure expansion bag. In the case of a square or rectangular housing, in accordance with FIG. 8 two opposing linear roller diaphragms 9 extend in accordance with the invention as far as the housing corners and have a deeper fold 21 than the other two roller diaphragms, which bear against the first-mentioned roller diaphragms and terminate there. This arrangement ensures secure sealing of the working-gas part volumes with respect to one another even in the housing corners at the same time as a simple wear-free construction of the linear roller diaphragms.

In accordance with FIG. 3, the to-and-fro movement of the displacer plate between the two housing plates can be effected by a linearly guided pushrod 28 (Watt's parallelogram, cross head, linear ball bearing) which is rigidly connected from the centre of one housing plate 2 perpendicular to the displacer plate 5 and which acts on the engine shaft 15 by way of the connecting rod 29. The displacer plate in this case moves sinusoidally, which results in an indicator diagram in accordance with FIG. 9 having rounded corners 30. Typically, linear guidance means for pushrods are not maintenance-free. A pushrod on which the entire heavy displacer plate is suspended limits the size of the displacer plates to approximately 2 by 2 m. As a result of harmonic movement, the displacer plate is not however subject to any major acceleration forces, and the engine can be balanced and runs very quietly.

However, to increase the output a discontinuous displacer movement is nevertheless desirable. The above-mentioned known engine to this end uses a crank drive which is bistably pre-tensioned and contains a pushrod which is pre-tensioned by a spring, one end of which is secured to the pushrod and the other end of which is secured to the lever arm of a fork. Between the tines of the fork an entrainer arranged on a lever arm of the diaphragm engine is displaceable in accordance with the travel of the diaphragm, two stable positions being predetermined as a result of the spring pre-tension. This arrangement is complicated, fragile and unsuitable for moving to and fro in an abrupt manner a heavy displacer plate several square meters in size.

The preferred raising and lowering mechanism of the displacer plate comprises, in accordance with FIGS. 1 and 4, a maintenance-free, low-friction, virtually wear-free low-pressure pneumatic system having toroidal diaphragms as the control expansion bag and raising expansion bags. On the cold side of the displacer plate 5 there are, in the corners of the displacer plate or in depressions in the housing plate 2, the raising expansion bags 13, into which air is forced and removed again by suction by a control expansion bag 14 which is contracted and expanded sinusoidally from the engine shaft by way of the connecting rod 16. Here, the movement of the raising expansion bags and the displacer plate is not sinusoidal, since the pressure rise in the sinusoidally moved control expansion bag is hyperbolic and the displacer plate begins to move as a result of its own weight only once a corresponding pressure in the raising system has been reached. The displacer plate is abruptly moved to the hot side as far as the stop, remains there while the control expansion bag compresses the air in the raising system somewhat more, and abruptly falls back to the cold side only when the pressure in the raising system has fallen again (in hyperbolic manner). The displacer movement is trapezoidal in accordance with FIG. 19. The discontinuous movement of the displacer plate results in more sharply extended corners 31 in the indicator diagram, which is known to increase the output density of the engine. The output of the engine is proportional to the area surrounded in the indicator diagram according to FIG. 9; W=§pdV. This raising mechanism enables heavy displacer plates several meters in length to be moved reliably. The displacer housing is no longer necessarily connected rigidly to the working expansion bag and the shaft but is attached for example by way of the flexible hoses 36, 38, so that the displacer box can follow the sun by means of one axis or two axes without difficulty (cf. FIG. 22).

To begin with, the air volume of the raising expansion bags 13 has a disadvantageous effect on the Stirling process, since it results in air being added to the working gas in the compression phase and being subtracted in the expansion phase, and thus makes more compression work necessary and permits less expansion work. To avoid having to accept this reduced engine output, it is possible in accordance with FIG. 11 to add to and remove from the working-gas volume precisely this air proportion of the raising expansion bags, offset by 180° from the control expansion bag 14, by way of a further expansion bag 32, so that the disadvantageous effect of the raising expansion bag volumes can be compensated. However, this further expansion bag volume can be superimposed by the volume of the working expansion bag, offset by 90° thereto (see FIG. 12), so that as a further .feature of the invention an optimum phase offset of larger than 90° results between the control expansion bag and the working expansion bag, and the additional compensation expansion bag 32 does not have to be incorporated.

In the above-mentioned known engine, the displacer is an unbroken air-impermeable plate. The regenerator is arranged fixedly on the housing end faces in the form of a narrow strip. In order to achieve freedom from friction, a gap is necessary between the displacer plate periphery and the regenerator or interior, as already mentioned above, as a result of which the regenerator becomes virtually ineffective, because most of the air flows through the gap and not through the regenerator. Because of the small cross-section Of the regenerator, it produces so much flow resistance that the discontinuous abrupt movement of the oscillating fork, produced by the bistable pre-tensioning, is transmitted only to an unsatisfactory extent to the displacer plate because of the damping Of the displacer plate which is produced.

In the present Stirling engine, the regenerator 18, which connects the expansion chamber 11 and the compression chamber 12, is arranged in the moving displacer plate 5 (FIGS. 1, 3, 4) and extends over the entire surface thereof and also occupies its entire volume. Regardless of the size of the housing, the regenerator has a thickness of at least approximately 0.1 m in order to isolate the hot expansion chamber and the cold compression chamber from one another, and preferably comprises open-pore polyester foam, which is heat-resistant, has a high specific heat capacity, conducts heat poorly and is thus an excellent regenerator for low-temperature engines. The large-surface regenerator does not present even abruptly performed displacer movements with anything but negligible flow resistance.

In the case of the above-mentioned known engine, the housing plates are at the same time the heat exchangers through which the fluid flows. However, these are capable of heating and cooling the working gas only to an unsatisfactory extent, since their surface is relatively small and the working gas is not forced to pass across it. In the case of practical low-temperature engines, in the interests of a high degree of efficiency, which depends primarily on the temperature difference between the hot and the cold engine sides, the attempt must be made to keep this temperature difference as large as possible. This is achieved only by making the heat exchange surfaces of such large dimensions and bringing them into contact with the working gas to such an extent that there is virtually no temperature difference between the heating and cooling fluid and the hot and cold working gas respectively.

In the case of the present Stirling engine, the heating means 19 and the cooling means 20 are mounted on the surfaces of the regenerator 18 facing the housing plates 1, 2 and are constructed to have a surface of virtually any size and such that gas can flow through, in the form of a finned heat exchanger. They are moved with the regenerator and are thus in intimate contact with the working gas. (Temperature difference measured between the heat exchanger fluid and the working gas: in the known engine 20° C., in the engine according to the invention2° C.). The heating means 19, the displacer 5, the cooling means 20 and the regenerator 18 form a moving unit in the engine according to the invention. The engine can be supplied from a low-temperature source (e.g. warm-water solar flat collector) or medium-temperature source (e.g. parabolic internal collector) (cf. FIG. 23). If an engine is driven mechanically, for example by a larger one or a plurality of others, it operates as a refrigerating machine (cf. FIG. 24). Here, the heat exchangers both operate as cooling means, one removing the pumped heat and the low temperature for the refrigerating circuit being produced in the other. The engines preferably lie horizontally, in particular such that the cooler heat exchanger is always lowermost in order to prevent convection of the working gas in the engine, which has proved itself to be a loss mechanism with a clear penalty as regards efficiency. If the machine has a transparent housing plate 1, the sun shines directly on the heat exchanger 19, which is now constructed as a gas-permeable, optically black surface without a fluid tube, and is typically simply the surface of the regenerator.

The above-mentioned known engine uses a normal (opaque) insulation material in order to insulate the outside of the heat exchangers from heat losses to the atmosphere. In the embodiment with a non-transparent housing plate 1, the engine according to the invention, which is preferably operated by sunlight by means of collectors and is typically erected outdoors in a manner accessible to sunlight, uses in accordance with FIG. 13 a transparent insulation 22 (polycarbonate honeycomb structures, aerogel etc. ) on the top housing plate 1 which is in contact with the working gas, in order to prevent heat losses in the working gas. To this end, the sun shines through the transparent insulation 22 onto the housing plate and keeps this hot so that no heat flow can take place between the plate and the working gas as a result of the lack of temperature difference. A negative temperature difference can even promote heating of the working gas. This transparent insulation effect is also achieved if the upper housing plate 1 in accordance with FIG. 14 is covered by warm-water solar flat collectors 23, the collector plates of which 53 supply the inner heat exchanger 19 with hot water by way of a fluid line 54. Here, not only is the heat loss of the collector by way of its rear side prevented, but the heat loss of the working gas by way of the upper housing plate is also eliminated, because the hot collector plate does not allow a flow of heat upwards. Normal insulation is dispensed with.

An embodiment according to the invention of the Stirling engine in accordance with FIG. 15 uses an upper highly heat-conductive housing plate 1 which forms a plate enlargement 33 and is larger than the displacer plate and thus projects beyond at least one end face and at the same time forms the optically black collector plate for incident sunlight and is typically covered by a glass pane 39 to prevent heat loss. The heat produced in the plate is transported by heat conduction to the plate region, below which the engine housing compartment is located. This transportation of heat in the plate can, in accordance with FIG. 15, be promoted by heat conductors which are mounted in or on the plate. In this case, the plate enlargement 33 may also comprise a plurality of plates connected by way of the heat conductors 24 to the housing plate 1 (see FIG. 16). The heat-conductive housing plate typically has, in accordance with FIGS. 15 and 16, on the inside of the engine compartment an enlarged surface, for example created by fins 25 or rods penetrating into the displacer plate or the regenerator 18 in order in this way to ensure good heat transmission to the working gas. The inner heat exchanger carried along with the regenerator is in this case omitted.

One embodiment of the engine according to the invention can be constructed in a particularly simple way with the following restrictions on its mode of operation if the engine operates as a work-producing engine having a suction expansion bag 8 (FIG. 17), that is to say with an underpressure by comparison with the atmosphere, and the engine lies horizontally with the hot side (expansion chamber ) 11 upwards, then if the correct choice of raising expansion bag diameters is made (they must be matched to the weight of the displacer plate and to the temperature difference between the warm and the cold engine sides), the control expansion bag can be omitted, since the pressure difference between the engine interior and the surroundings is alone sufficient to raise the displacer plate 5. Now, the raising expansion bags 13 are open to the atmosphere at the bottom. As a result of the temperature difference between the warm and the cold engine sides, the flow resistance of the regenerator, the weight of the displacer plate and the choice of size of the openings 55 between the raising expansion bag interior spaces and the atmosphere, the desired phase offset of approximately 90 degrees is automatically established between the working expansion bag movement and the displacer movement, but is sensitive to a change in load on the engine shaft. Here, the movement of the displacer plate is also discontinuous.

If the engine operates as a work-producing engine having as the working expansion bag a pressure expansion bag 7 (FIG. 18), that is to say with an overpressure with respect to the atmosphere, then it is also possible to move the displacer plate without a control expansion bag, either if the hot engine side is at the bottom and the raising expansion bags are arranged at the top, or, with the hot engine side desired to be at the top, if the displacer plate 5 is held on the hot side by springs 40 and is drawn towards the cold side by the raising expansion bags 13—which in this case are drawing expansion bags. For reasons of material technology, the raising expansion bags must always be arranged on the cold engine side. If this engine embodiment is operated as a refrigerating machine without a control expansion bag, then in order to prevent convection in the engine, as in the case of the work-producing engine, the colder heat exchanger should be at the bottom. In this case, it is the cold-generating heat exchanger. This is possible if the engine is operated at below the atmospheric pressure (FIG. 17), the phase offset between the displacer movement and the working expansion bag movement being established automatically. However, in the form of a refrigerating machine, a higher output density can be required than can be achieved using the suction engine. However, in the form of a refrigerating machine with a pressure expansion bag, an inverse phase relation (offset by 270°, the cold side seeking to arise at the top) is produced.

For this reason, an embodiment according to the invention of the refrigerating machine (FIG. 19) uses two valves between the raising expansion bag interior and the atmosphere. One of them 41 is spring-loaded and allows the air from the raising expansion bag interior to escape to the atmosphere from a certain pressure in the raising expansion bag 13 onwards. The second 42 is loaded by way of a diaphragm 43 by the internal pressure of the raising expansion bag, and allows the air to flow into the raising expansion bag only below a certain internal pressure of the expansion bag, in that the diaphragm exerts the function of the flap of a valve and temporarily keeps the flow path closed. This valve arrangement, given the correct choice of valve loads, offsets the phase relation by 180°, and the cold-generating side of the engine is established at the bottom as desired.

An embodiment according to the invention of the Stirling engine according to FIG. 20 uses, for the purpose of cooling the cold engine side 12, water 44 which is passed through an inlet 49 into the engine compartment, is located above the lower housing plate, and is drained off again by way of an outlet 50. The cooling effect is significantly increased if fins, rods, wires or the like 45 penetrate into the water, which are secured to the regenerator 18 and are dipped into the water and withdrawn by means of their motion and provide a large heat exchange surface to the working gas to be cooled. Here, it must be ensured that the regenerator is not wetted by water, because the regenerator effect will be lost and gas can no longer flow through the regenerator. To this end, an embodiment according to the invention uses, below the regenerator, a mat 46 of knitted wires, plastics fleece or the like which functions as a means of removing sprayed water from the working gas, but can also remove droplets dripping down from the wires. This mat can replace the above-mentioned cooling fins and can itself dip into the cooling water above the plate. The mat can also be part of the regenerator itself.

An embodiment according to the invention of the Stirling engine (FIG. 21) acts by means of the working expansion bag by way of a connecting rod not on an engine shaft but causes a mass to oscillate, for example a pendulum which performs the compressive work instead of the flywheel. This arrangement has the advantage that the engine operates at the same frequency over the entire output range and an increase in output is expressed as a larger oscillation amplitude, so that for example when driving reciprocating piston water pumps the output can be regulated simply by altering the stroke. A particularly simple embodiment of the Stirling engine uses as the oscillating mass or a part thereof the water column 51 of an inertia water raising device 52. During its upward movement, the water column conveys for each oscillation part of the water from the base valve 53 in the well upwards 54 and at the same time compresses the working gas in the Stirling engine. The water column is pressed downward during the expansion phase of the working expansion bag 7.

I claim:

1. A Stirling engine with a heat exchanger, designed for low-temperature to medium-temperature operation, that is to say for a small compression ratio and a large displaced volume, in which a displacer plate is movable to and fro between two mutually parallel housing plates of a housing and is free of sliding friction along the periphery with respect to the end faces of the housing, the displacer plate separating two working-gas part-volumes, the expansion chamber and the compression chamber, from one another, with which for the purpose of heat exchange, cooling means and heating means are associated, the two working-gas part-volumes being connected to one another by way of a regenerator, and the to-and-fro movement of the displacer plate being timed to a working piston with phase offset, characterized in that the two housing plates (1), (2) are held spaced from one another by distributed struts (3), (4), the struts (3), (4), being arranged perpendicular to the displacer plate (5) and passing there-through, and in that the displacer plate (5) is guided with respect to the housing end faces (10) along its end edges by linear roller diaphragms (9).

2. A Stirling engine according to claim 1, characterized in that, for the to-and-for movement of the displacer plate (5), motion air expansion bags (13) are provided between the latter and one housing plate (2), and the motion air expansion bags are actuable by means of a control expansion bag (14) and are connected thereto conductively for the supply and removal of air, this control expansion bag (14) being contractable and expandable by way of a connecting pushrod (16).

3. A Stirling engine according to claim 2, characterized in that the volume of the motion air expansion bags is compensated by the change in phase relation (17) between the movement of the control expansion bag and the movement of the working expansion bag from 90° to greater than 90°.

4. A Stirling engine according to claim 2, characterized in that the struts can take up tensile and compressive forces and a small opening in the engine housing keeps the pressure in the working expansion bag on average at atmospheric pressure.

5. A Stirling engine according to claim 2, characterized in that the struts are each constructed as tensioning tie rods (3) and a non-return valve (6) sets the air pressure in the working expansion bag (7) to a value equal to or greater than atmospheric pressure.

6. A Stirling engine according to claim 2, characterized in that the struts are each constructed as reinforcing supports (4) and a non-return valve (6) sets the air pressure in the working expansion bag (7) to a value substantially equal to atmospheric pressure.

7. A Stirling engine according to claim 1, characterized in that the regenerator (18) is provided on the displacer plate (5) and extends over the entire surface thereof.

8. A Stirling engine according to claim 7, characterized in that the regenerator carries the two heat exchangers (19, 20) on its surfaces facing the housing plates (1, 2), these heat exchangers (19, 20) being constructed such that gas can flow through them.

9. A Stirling engine according to claim 8, characterized in that the displacer housing is arranged to be horizontal and the cooler heat exchanger is arranged so as to be lowermost.

10. A Stirling engine according to claim 1, characterized in that, with a square or rectangular housing, two opposing roller diaphragms (9) extend into the housing corners and have a deeper fold (21) than the other two (9), which bear against the first-mentioned roller diaphragms with their end sides and terminate there.

11. A Stirling engine according to one of claims 1 to 10, characterized in that the housing plate (1) belonging to the (expansion chamber 11) is provided on the outside with a transparent insulation (22).

12. A Stirling engine according to claim 1, characterized in that a housing plate (33) is larger in area than the area of the displacer plate, that it projects beyond at least one end side of the displacer plate and at the same time forms an optically black collector plate for incident sunlight.

13. A Stirling engine according to claim 12, characterized in that the heat transportation in the direction in which the housing plate (33) extends is promoted by heat conductors (24) embedded therein or secured thereto.

14. A Stirling engine according to claim 12, characterized in that the surface of the housing plate (33) located in the engine compartment is enlarged by fins (25) which can penetrate into the regenerator (18).

15. A Stirling engine according to claim 2, characterized in that the to-and-fro movement of the displacer plate is performed by raising expansion bags, the interiors of which are connected to the atmosphere.

16. A Stirling engine according to claim 15, characterized in that the connection between the raising expansion bag interiors and the atmosphere is controlled by way of valves (41, 42).

17. A Stirling engine according to claim 1, characterized in that cooling water (44) is passed through the engine compartment above the lower housing plate (2) and is located above the housing plate so that it takes on the function of the cold heat exchanger.

18. A Stirling engine according to claim 17, characterized in that fins (45) are mounted on the displacer plate and penetrate below the water surface.

19. A Stirling engine according to claim 1, characterized in that means (46) for removing sprayed water is mounted on the regenerator underside in the form of cooling means.

20. A Stirling engine according to claim 2, characterized in that the working expansion bag does not act on an engine shaft but causes a mass (50) to oscillate.

21. A Stirling engine according to claim 2, characterized in that the working expansion bag but causes the water column of an inertial water raising device to oscillate.

* * * * *